US006240846B1

(12) United States Patent
Brenk et al.

(10) Patent No.: US 6,240,846 B1
(45) Date of Patent: Jun. 5, 2001

(54) RECORDING MATERIAL COMPRISING A SUBSTRATE AND A CERAMIC LAYER APPLIED TO A SURFACE OF THE SUBSTRATE

(75) Inventors: Michael Brenk; Eva Danuta Allen, both of Wiesbaden (DE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 09/377,154

(22) Filed: Aug. 19, 1999

(30) Foreign Application Priority Data

Aug. 29, 1998 (DE) ..... 198 39 454

(51) Int. Cl.[7] ..... B41N 1/08; B41N 3/00
(52) U.S. Cl. ..... 101/455; 101/463.1
(58) Field of Search ..... 101/453, 454, 101/456, 458, 459, 455, 463.1, 465–467

(56) References Cited

U.S. PATENT DOCUMENTS

| | | | | |
|---|---|---|---|---|
| 3,470,013 | * | 9/1969 | Wagner | 101/453 |
| 3,871,881 | | 3/1975 | Mikelsons | 430/60 |
| 3,902,976 | * | 9/1975 | Walls | 101/459 |
| 4,293,625 | * | 10/1981 | Myers | 430/9 |
| 4,420,549 | | 12/1983 | Cadwell | 430/158 |
| 5,464,724 | * | 11/1995 | Akiyama et al. | 101/456 |
| 5,927,207 | * | 7/1999 | Ghosh et al. | 101/455 |
| 6,105,500 | * | 8/2000 | Bhambra et al. | 101/455 |

FOREIGN PATENT DOCUMENTS

| | | |
|---|---|---|
| 25 04 545 | 8/1976 | (DE) . |
| 0 087 469 | 9/1983 | (EP) . |
| 94/05507 | 3/1994 | (WO) . |
| 97/19819 | 6/1997 | (WO) . |

* cited by examiner

*Primary Examiner*—Stephen R. Funk
(74) *Attorney, Agent, or Firm*—Foley & Lardner

(57) ABSTRACT

A ceramic layer comprising aluminum oxide and a silicate compound is applied to a substrate of a printing plate, with the silicate compound acting as a binder to ensure adhesion of the ceramic layer to the substrate.

23 Claims, No Drawings

RECORDING MATERIAL COMPRISING A SUBSTRATE AND A CERAMIC LAYER APPLIED TO A SURFACE OF THE SUBSTRATE

BACKGROUND OF THE INVENTION

1. Field of the Invention

The present invention relates to a recording material comprising a substrate and a ceramic layer applied to a surface of the substrate and also a light-sensitive layer, as well as to a process for producing a recording material.

2. Description of Related Art

To produce the lithographic printing plates used in lithographic processes, image areas and non-image areas are typically produced on a substrate, with the non-image areas generally being hydrophilic and the image areas generally being oleophilic. Accordingly, oil-based printing inks are generally repelled by the non-image areas after water has been applied to the substrate. Both the non-image areas and the image areas are produced by illumination of a light-sensitive recording layer on the surface of the substrate. The illumination results in differences in the solubility of the image areas and the non-image areas.

The preparation of the substrate prior to application of the light-sensitive layer not only has to ensure that the light-sensitive recording layer adheres firmly to the substrate, but it should also permit the soluble image material to be removed after development. Substrate materials for lithographic printing plates include, in general, aluminum and aluminum alloys which have a layer of aluminum oxide on their surface and a light-sensitive recording layer applied thereto. The aluminum oxide layer can be produced using an oxidation process which is generally carried out electrochemically. Prior to the oxidation, the surface of the aluminum substrate can be cleaned and this is followed by an etching process which provides the surface of the aluminum substrate with a textured layer, thus increasing the surface area of the substrate, which in turn determines the strength of bonding between substrate and the recording layer. The textured surface also helps to increase water retention.

Disadvantages of the known methods of preparing the substrates of lithographic printing plates include at least the following. For example, a large amount of electric energy is typically required for roughening and oxidizing the substrate surface. In addition, the roughening achieved by etching can generally only be carried out only relatively slowly. A further disadvantage is that the reprocessing of the waste products formed during the anodizing and during the roughening of the substrate is expensive.

To avoid these disadvantages, DE-C 25 04 545 (DE '545) proposes coating an aluminum substrate of a lithographic printing plate by using aluminum hydroxide formed in situ, with the coating comprising particulate material having a mean particle size of from 0.05 to 3000 $\mu$m and the particulate material being applied to the substrate prior to the in-situ formation of the aluminum hydroxide. The particulate material can be, for example, selected from the group consisting of titanium dioxide, zinc oxide, $\gamma$-iron(III) oxide, barium titanate, aluminum oxide, cerium oxide and zirconium oxide. The particulate material is bound to the surface of the aluminum substrate by aluminum hydroxide formed in situ. The aluminum hydroxide is formed by exposing the aluminum surface coated with the particulate material to an oxidizing environment comprising water. Thus, the surface of the aluminum substrate is oxidized to form hydrated aluminum oxide which grows in the form of crystallites around the particular material to form a matrix which binds the particulate material firmly to the surface of the aluminum substrate. The particulate material can, for example, be dusted onto the surface of the aluminum substrate and subsequently be exposed to an oxidizing atmosphere. Likewise, the particulate material can be applied to the aluminum substrate from a dispersion of the particulate material in a liquid carrier, after which the major part of the liquid carrier or all of the liquid carrier is evaporated. Suitable liquid carriers include water, lower aliphatic alcohols such as methanol, ethanol, isopropanol, n-propanol, n-butanol and isobutanol, lower aliphatic ketones, aliphatic hydrocarbons having from about 6 to 12 carbon atoms, aromatic hydrocarbons and mixtures of these carriers.

DE '545 also discloses increasing the effectiveness of the binding process by additions of, inter alia, sodium hydroxide, sodium bicarbonate, sodium acetate, magnesium oxide, calcium oxide, calcium carbonate, barium carbonate, magnesium nitrate, calcium nitrate, calcium fluoride, barium nitrate and calcium acetate. To produce the coating, the coated aluminum substrate is generally first wetted with water and subsequently placed in an open vessel into which steam under pressure is introduced. The aluminum substrate is exposed to the steam at 100° C., for example, for 15 minutes, and is then dried.

WO 94/05507 discloses a process in which particles whose particle size extends from 2 $\mu$m to 15 $\mu$m are applied to the surface of a substrate by a thermal spraying technique or by plasma spraying. The material to be applied is, for example, aluminum oxide ($Al_2O_3$). The thermal spraying technique is based on flame spraying. Particular preference is given to a process using a plasma spraying technique in which the powder is sprayed on in an atmosphere of inert gas, for example hydrogen, nitrogen or argon or mixtures of these or other gases. The gas is heated by an electric arc, for example, to at least $10^{4\circ}$ C. (10,000° C.), in particular to $2\times10^{4\circ}$ C. (20,000°). As a result, the energy consumption of this technique is very high. The same applies to flame spraying in which the support material is in close contact with a block of material which has a high thermal mass and is accordingly held at a prescribed temperature.

EP-B-0 087 469 describes a process in which a ceramic layer is formed on an aluminum substrate by applying a slurry of at least one monobasic phosphate and nonmetallic inorganic particles to the surface of the aluminum substrate and forming a ceramic coating on the aluminum substrate by firing the slurry at a temperature of at least 230° C. The ceramic layer is then coated with a light-sensitive lithographic layer. Some of the particles in the slurry are metal oxide particles having average particle sizes of from 0.001 to 45 $\mu$m, where the metal oxide particles are aluminum oxide particles. The ceramic layer comprises a reaction product of aluminum oxide with a monobasic phosphate and a reaction product of a metal oxide which is not aluminum oxide with a monobasic phosphate. The orthophosphate of the metal oxide is insoluble in an aqueous solution having a pH of from 6 to 12.

SUMMARY OF THE INVENTION

It was one object of the invention to provide a recording material comprising a ceramic layer. It was a further object to provide a process for producing such a recording material which, without consuming a large amount of energy, leads to very good and durable adhesion of the ceramic layer to the substrate. Furthermore, it was an object of the present invention to produce a lithographic printing plate from the recording material which ensures a long print run with essentially no fogging.

These and other objects can be achieved according to the invention by providing a recording material comprising a substrate, a ceramic layer applied to a surface of the substrate and a light-sensitive layer, wherein the ceramic layer comprises at least one silicate compound and aluminum oxide with an aluminum purity of at least 99.6% by weight, and the ceramic layer adheres to the substrate with the silicate compound functioning as a binder.

In further accordance with these and other objects, there is also provided a process for producing a recording material comprising applying an aqueous dispersion of aluminum oxide and a silicate compound, either alone or together with titanium dioxide and/or silicon dioxide, to a substrate, and drying the substrate with the aqueous dispersion at a temperature of from 150° C. to 220° C. for from 50 to 80 seconds.

Additional objects, features and advantages of the invention will be set forth in the description which follows, and in part will be obvious from the description, or may be learned by practice of the invention. The objects, features and advantages of the invention may be realized and obtained by means of the instrumentalities and combinations particularly pointed out in the appended claims.

DETAILED DESCRIPTION OF THE PREFERRED EMBODIMENT

The ceramic layer preferably comprises a silicate compound together with aluminum oxide with an aluminum purity of at least 99.6% by weight. In addition, the ceramic layer preferably adheres to the substrate by means of the silicate compound acting as a binder.

In an embodiment of the invention, the aluminum oxide $Al_2O_3$ is pulverized as it is described, for example, in the document "Oxides and Hydroxides of Aluminum, Alcoa Laboratories 1987, page 20, chapter 2.4.12 and the particle size of the pulverized aluminum oxide $Al_2O_3$ is in the range from 0.20 to 3 $\mu$m and the aluminum oxide is applied together with the silicate compound (the binder) and water as an aqueous dispersion to the substrate and is bound to the latter by means of heat. In the dispersion the particle size distribution is within a range from 0.5 to 15 $\mu$m with a mean particle size of 4.5 $\mu$m.

The aluminum oxide with an aluminum purity of 99.6 to 99.8% by weight advantageously further comprises one or more of, advantageously from 0.2 to 0.4% by weight of sodium oxide, silicon oxide, iron oxide, calcium oxide and magnesium oxide.

In a further embodiment of the invention, the ceramic layer comprises aluminum oxide, at least one titanium compound and at least one silicate compound. The titanium compound is preferably $TiO_2$ and its proportion is preferably from 10 to 90% by weight, in particular from 15 to 30% by weight, based on the weight of the ceramic layer. It is likewise possible for the ceramic layer to comprise aluminum oxide, at least one silicon compound and at least one silicate compound. Suitable compounds instead of $TiO_2$ are zirconium oxide or -hydroxide, oxides of boron and germanium.

Silicate compounds which are suitable according to the invention include a sodium silicate in the form of sodium water glass as a binder, where the solids content of an aqueous solution of the sodium water glass is advantageously 30% by weight, and advantageously from 2 to 4 mol of $SiO_2$ are present per 1 mole of sodium oxide ($Na_2O$). Another suitable silicate compound is potassium silicate, which is not so sensitive to air-carbon dioxide than sodium silicate.

The silicon compound is advantageously $SiO_2$ whose proportion together with the $SiO_2$ from the silicate compound is preferably from 25 to 80% by weight, and the proportion of $Na_2O$ from the silicate compound is preferably from 5 to 10% or from 5 to 8% by weight of the ceramic layer, and the percentage of aluminum oxide $Al_2O_3$ generally makes up the balance to 100% by weight, all based on the weight of the ceramic layer. Other suitable silicon compounds are alkylsilanes, which will be hydrolysed during the drying process and therefore the process would be more difficult to control.

In a further embodiment of the invention, the ceramic layer advantageously comprises aluminum oxide, titanium dioxide, silicon dioxide and a silicate compound, where the proportion of aluminum oxide is preferably from 35 to 55% by weight and those of titanium dioxide and of silicon dioxide are each preferably from 15 to 25% by weight, in each case based on the weight of the ceramic layer.

A suitable process for producing a recording material comprises applying the aqueous dispersion of aluminum oxide and a silicate compound, either alone or together with titanium dioxide and/or silicon dioxide, to a substrate using any suitable method such as by using a pad, a roller or a doctor blade, and drying the coated substrate at a temperature of preferably from 150 to 220° C., suitably for from 50 to 80 seconds. The drying temperature can also start, for example, at 140° C. and extend to suitably 220° C. The drying time can then suitably be from 50 seconds to 120 seconds. An optional second drying step can follow if desired, suitably at a temperature from 190° C. to 280° C. A likewise drying method is disclosed in U.S. Pat. No. 4,420,549.

The present invention enables a recording material to be provided with a ceramic coating in a surprisingly simple manner, generally without the need for a high electric energy input as required in plasma spraying, thermal flame spraying or in the treatment of a recording material which is coated with a titanium dioxide dispersion with steam under pressure.

According to the present invention, the substrate can be coated with a metal oxide dispersion by pad, roller or doctor blade coating, i.e. by very low-energy, conventional application methods. The temperatures for drying the applied dispersion layer, suitably in the range from 140° C. to 220° C., also generally require relative little electrical heat energy. This also applies to any optional further drying at a temperature, for example, of from 190 to 280° C. The ceramic layer advantageously has a thickness in some embodiments from 0.6 to 10 $\mu$m, in particular in the range from 3,2 to 20 $\mu$m.

The recording material of the invention advantageously possesses a hydrophilic ceramic layer which has a textured surface. This ceramic layer thus replaces necessary and often undesirable process steps of (i) customary electrochemical roughening and (ii) subsequent anodization of the surface of the recording material in the conventional methods of producing a recording material suitable for printing plates. These two process steps are not only very energy-intensive, but, in addition, result in waste products which have to be worked up before they can be deposited in a landfill.

The invention is illustrated below in the following non-limiting explanations:

Prior to the application of the coating, substrates of metal such as aluminum, steel, brass or copper can be pickled using a mixture of sodium hydroxide as main constituent, sodium phosphate and a wetting agent (product name: GRISAL from Messer-Griesheim), generally at room temperature for from 60 to 120 seconds, and subsequently rinsed with deionized water. The supports are then coated with an aqueous dispersion of aluminum oxide ($Al_2O_3$) and a silicate compound such as water glass. The term "water glass" refers to water-soluble potassium and sodium silicates, i.e. salts of silicic acids, or their viscous aqueous solutions. In water glass, from 2 to 4 mol of $SiO_2$ are preferably present per 1 mole of alkali metal oxide. Thus, the sodium and potassium water glasses are usually characterized by the mass ratio or molar ratio of $SiO_2$ to alkali metal oxide, as well as by their density in aqueous solution. The molar ratio of $SiO_2$ to $Na_2O$ of sodium water glass is preferably in the range from 3.0 to 3.5, and is in particular 3.4 or about 3.4. Owing to hydrolysis, they advantageously mainly comprise hydrogen-containing salts such as $M_3HSiO_4$, $M_2H_2SiO_4$ and $MH_3SiO_4$ where M=potassium or sodium. For the purposes of the present invention, preference is given to using substrates of aluminum and to using sodium water glass as binder for the ceramic layer in the aqueous dispersion, however, any other substrate and/or binders can be substituted if desired for any reason. The proportion of aluminum oxide ($Al_2O_3$) in the aqueous dispersion can advantageously be from 19 to 28% by weight, in particular 26% or about 26% based on the weight of the dispersion. The particle size of the pulverized aluminum oxide $Al_2O_3$ can advantageously be in the range from 0.2 to 3 $\mu$m and the aqueous dispersion of the aluminum oxide, the water glass and deionized water can be bound to the substrate if desired by any method, such as by heating. In a first drying step, the temperature is preferably from 140 to 220° C., with the drying time preferably being from 50 to 120 seconds. The aqueous dispersion can be applied by any suitable means such as by a pad, a roller or a doctor blade. After the optional second drying step at temperatures of advantageously from 190° C. to 180° C., an abrasion-resistant ceramic layer which has a structure with particle sizes from 0.5 to 15 $\mu$m diameter, in particular of 4.5 $\mu$m and has a thickness of from about 3.2 $\mu$m to 20 $\mu$m is obtained. Any suitable light-sensitive layer is applied to this ceramic layer comprising $Al_2O_3$ and a silicate compound.

EXAMPLES 1–10

Table 1 below lists the weights of the constituents of the aqueous dispersion comprising aluminum oxide, sodium water glass and deionized water for various examples. Table 1 also indicates the print run length, the fogging and the temperatures in the 1$^{st}$ and 2$^{nd}$ drying steps for the printing plates which are coated with a ceramic layer produced by means of the dispersions specified. The solids content of the sodium water glass is 30%, i.e., 100 g of sodium water glass contain 30 g of solid sodium water glass. The molar ratio of the oxides present in the sodium water glass was 3.4 in the dispersions, i.e., of 30 g of solids, 23.2 g are $SiO_2$ and 6.8 g are $Na_2O$, as can be deduced from the relationship $SiO_2$:$Na_2O$=3.4:1.

From Examples 1 and 2 on the one hand and Examples 3 to 10 on the other hand, the percentage composition of the constituents of the ceramic layer was calculated, with the assumption that after the 2$^{nd}$ drying step only the solid constituents of the sodium water glass, namely $SiO_2$ and $Na_2O$, and the aluminum oxide $Al_2O_3$ are still present in the ceramic layer. At a solids content of 30 g of sodium water glass and an $Al_2O_3$ content of from 43.5 g to 58.8 g, the derived percentage composition of the ceramic layer is: $SiO_2$ in the range from 59.2 to 66.2% by weight, $Na_2O$ in the range from 7.7 to 9.5% by weight and $Al_2O_3$ in the range from 59.2 to 66.2% by weight. Further experiments using a larger amount of sodium water glass together with the same amount of $Al_2O_3$ in Examples 1 to 10 show that an $Al_2O_3$ content of 45% by weight in the ceramic layer leaves its print quality substantially unchanged.

TABLE 1

| Dispersion constituents | Product name | Examples 1 | 2 | 3 | 4 | 5 | 6 | 7 | 8 | 9 | 10 |
|---|---|---|---|---|---|---|---|---|---|---|---|
| Sodium water glass | | 100 g | 100 g | 100 g | 100 g | 100 g | 100 g | 100 g | 100 g | 100 g | 100 g |
| Aluminum oxide | P807 ALCOA | 43.5 g | | 58.8 g | 58.8 g | | | | | | |
| Aluminum oxide | P808 ALCOA | | 43.5 g | | | 58.8 g | 58.8 g | | | 58.8 g | 58.8 g |
| Aluminum oxide | P172SB PECHINEY | | | | | | | 58.8 g | 58.8 g | | |
| Deionized water | | 78.9 g | 78.9 g | 67.1 g | 67.1 g | 67.1 g | 67.1 g | 67.1 g | 67.1 g | 67.1 g | 67.1 g |
| Print run | | 5,000 | 5,000 | 150,000 | 100,000 | 190,000 | 100,000 | 150,000 | 100,000 | 150,000 | 150,000 |
| Fogging | | none | none | none | very low | none | Low | none | very low | none | none |
| 1$^{st}$ drying, 60 s | | 190° | 190° | 190° | 190° | 190° | 190° | 190° | 190° | 145° 148° (120 s) | 145° |
| 2$^{nd}$ drying, 60 s | | 270° | 270° | 230° | 270° | 230° | 270° | 230° | 270° | | 190° |

The aluminum oxide $Al_2O_3$ preferably has aluminum with a purity of from 99.6 to 99.8% by weight and can further comprise one or more of sodium oxide, silicon oxide, iron oxide, calcium oxide and magnesium oxide, which together preferably make up from 0.20 to 0.4% by weight based on the weight of the ceramic layer. The aqueous dispersion of aluminum oxide ($Al_2O_3$) can be obtained by any suitable means, such as by milling a mixture of pulverized aluminum oxide, sodium water glass and deionized water in a ball mill or by using dispersing disks.

In another embodiment of the invention, the ceramic layer preferably comprises silicon dioxide and a titanium compound which may be, for example, $TiO_2$. The proportion of titanium dioxide is advantageously in the range from 10 to 90% by weight, in particular from 15 to 30% by weight, based on the weight of the ceramic layer.

To produce a recording material having a low titanium dioxide content, use can be made, for example, of an aqueous dispersion comprising, for example, 18% by weight of $SiO_2$, 6% by weight of $TiO_2$, 50% by weight of water glass, 25% by weight of deionized water and 1% by weight of additives. The incorporation of various additives into the dispersion inter alia, increases the effectiveness of the binding to the substrate. These additives are particularly advantageous, for example, when the ceramic layer is desired to have a relatively high thickness in the range of 3.2 to 20 $\mu$m. However, such additives are typically not absolutely necessary since the adhesion of the ceramic layer is fully satisfactory, even without such additives. These additives can be, for example, fluorinated hydrocarbon compounds such as polyvinylidene fluoride or a copolymer of vinyl chloride and vinyl isobutyl ether. The fluorinated hydrocarbon can advantageously be included in an amount of up to 1% by weight based on the weight of the ceramic layer. The fluorinated hydrocarbon can also comprise up to 1% by weight of the aqueous dispersion based on the weight of the dispersion. In the above-described example, the proportion of water in the dispersion can advantageously be increased by 1% if the dispersion is prepared without use of such additives.

In a further embodiment of the invention, the ceramic layer comprises aluminum oxide, a silicon compound which may be, for example, $SiO_2$, and a silicate compound. The proportion of the silicon compound in the ceramic layer together with the proportion of $SiO_2$ from the silicate compound is advantageously from 25 to 80% by weight of the ceramic layer. The sodium oxide ($Na_2O$) from the silicate compound preferably makes up from 5 to 10% by weight of the ceramic layer. The aluminum oxide preferably makes up the balance of the ceramic layer. To produce such a ceramic layer, a dispersion comprising, for example, from 35 to 48% by weight of sodium water glass, from 14 to 17% by weight of aluminum oxide $Al_2O_3$, 6% by weight of silicon dioxide $SiO_2$ and from 32 to 42% by weight of deionized water is applied to the substrate.

EXAMPLES 11 to 25

Table 2 lists the constituents of the aqueous dispersion comprising titanium dioxide $TiO_2$, silicon dioxide $SiO_2$, sodium water glass, deionized water and various additives such as phosphoric acid, polyvinylidene fluoride, vinyl chloride-vinyl isobutyl ether and hydroxymethylcellulose. Table 2 also indicates the print run length, the fogging and the temperatures in the $1^{st}$ and $2^{nd}$ drying steps. Otherwise, the statements made in connection with Examples 1 to 10 regarding the solids content of the sodium water glass and the molar ratio of $SiO_2$ to $Na_2O$ in the sodium water glass apply.

From Examples 12 to 14 on the one hand, and Example 16 on the other hand, the percentage composition of the constituents of the ceramic layer was determined with the assumption that after the $2^{nd}$ drying step the following constituents are present in the ceramic layer: $SiO_2$ and $Na_2O$ as solid constituents of the sodium water glass, $SiO_2$ which was present in the dispersion as silica and diatoms, and titanium dioxide. At a solids content of 50 g of sodium water glass, from 48 to 72.7 g of $SiO_2$ and from 18 to 27.3 g of titanium dioxide $TiO_2$, the percentage composition is: Fluorad: from 0.1 to 0.2% by weight, $SiO_2$: from 74 to 75% by weight, $Na_2O$: from 7.6 to 9.8% by weight, $TiO_2$: from 15.5 to 18.2% by weight.

TABLE 2a (Examples 11 to 18)

| Dispersion constituents | | Examples | | | | | | | |
|---|---|---|---|---|---|---|---|---|---|
| (g) | Product name | 11 | 12 | 13 | 14 | 15 | 16 | 17 | 18 |
| Phosphoric acid | | | | | | | | | |
| Wetting agent | Fluorad FC98 | 0.167 | 0.167 | 0.167 | 0.167 | 0.167 | 0.167 | | |
| Sodium water glass | | 150 | | 150 | 150 | 150 | 150 | 150 | 150 |
| Silica $SiO_2$ | Cab-O-Sil M5 | 3 | 3 | | | | 4.5 | | |
| Silica $SiO_2$ | Gasil 114 | | | 3 | | | | | 65.1 |
| Silica $SiO_2$ | HP 250 | | | | 3 | | | | |
| Titanium dioxide $TiO_2$ | | 18 | 18 | 18 | 18 | 18 | 27.3 | | |
| Diatoms $SiO_2$ | Celite White Snow Floss | 45 | 45 | 45 | 45 | 45 | 68.2 | 65.25 | |
| Polyvinylidene fluoride | Vidar 1002 | 3 | | | | | | | |
| Vinyl chloride-vinyl isobutyl ether copolymer | Hostaflex CM620 | | | | | | | | |
| Hydroxymethylcellulose | Tylose C10000 | | | | | | | | |
| Deionized water | | 120 | 120 | 120 | 120 | 100 | 179.6 | 118.35 | 208.5 |
| Total | | 339 | 336 | 336 | 336 | 313 | 429.6 | 333.6 | 423.6 |
| Print run | | 190,000 | 5000 | 10,000 | 10,000 | 20,000 | 13,000 | 40,000 | 40,000 |
| Fogging | | ○ | ○ | + | ○ | ○ | ○ | ○ | ○ |
| $1^{st}$ drying, 60 s | | 190° | 190° | 190° | 190° | 190° | 190° | 190° | 190° |
| $2^{nd}$ drying, 60 s (max. 280° C.) | | 270° | 270° | 270° | 270° | 270° | 270° | 270° | 270° |

○ = no fogging, + = very low fogging

TABLE 2b (Examples 19 to 25)

| Dispersion constituents (g) | Product name | Examples 19 | 20 | 21 | 22 | 23 | 24 | 25 |
|---|---|---|---|---|---|---|---|---|
| Phosphoric acid | | | 3.85 | 6 | 6 | 6 | | 6 |
| Wetting agent | Fluorad FC98 | 0.167 | 0.167 | 0.167 | | 0.167 | 0.167 | 0.167 |
| Sodium water glass | | 150 | 150 | 150 | 150 | 150 | 150 | 150 |
| Silica $SiO_2$ | Cab-O-Sil M5 | 3 | 3 | 3 | 3.15 | 3.15 | | 3 |
| Silica $SiO_2$ | Gasil 114 | | | | | | | |
| Silica $SiO_2$ | HP 250 | | | | | | | |
| Titanium dioxide $TiO_2$ | | 18 | 18 | 18 | 18.81 | 18.81 | 18.81 | 18 |
| Diatoms $SiO_2$ | Celite White Snow Floss | 45 | 45 | 45 | 47.04 | 47.04 | 47.04 | 45 |
| Polyvinylidene fluoride | Vidar 1002 | 3 | | 3 | | | 3.15 | |
| Vinyl chloride-vinyl isobutyl ether copolymer | Hostaflex CM620 | | | | | | | 3 |
| Hydroxymethylcellulose | Tylose C10000 | 2.4 | | | | | | |
| Deionized water | | 255 | 182.5 | 210 | 185.1 | 185.1 | 185.1 | 185.1 |
| Total | | 476.4 | 398.5 | 429 | 404.1 | 404.1 | 404.1 | 404.1 |
| Print run | | 22,500 | 10,000 | 130,000 | 50,000 | 40,000 | 80,000 | 110,000 |
| Fogging | | + | + | ○ | + | ○ | ○ | + |
| 1st drying, 60 s | | 190° | 220° | 190° | 190° | 190° | 190° | 190° |
| 2nd drying, 60 s (max. 280° C.) | | 270° | 270° | 270° | 270° | 270° | 270° | 270° |

○ = no fogging, + = very low fogging

In another embodiment of the invention, the ceramic layer of the recording material advantageously comprises aluminum oxide, titanium dioxide and silicon dioxide and a silicate compound. Here, the proportion of aluminum oxide is preferably from 35 to 55% by weight, while those of titanium dioxide and of silicon dioxide are from 15 to 25% by weight, and the proportion of sodium oxide ($Na_2O$) from the silicate compound is advantageously from 5 to 8% by weight based on the weight of the ceramic layer.

As mentioned above, incorporation of various additives into the dispersion or into the sodium water glass can increase the binding action of the dispersion on the substrate. These additives include, inter alia, one or more cellulose compounds such as hydroxymethylcellulose (productname: TyloseC10000)which can act under many circumstances as stabilizers. In general, the ratio of sodium water glass to the stabilizer is preferably in the range from 1.5:1 to 4:1.

The stabilizers which can be added to the sodium water glass include one or more selected from the group consisting of silicone resin emulsions, phenylmethylpolysiloxane resin solutions, modified acrylic polymers, xylene, propylene glycol, antifoams based on mineral oils and polysiloxanes. Such additives, if included, can preferably be in amount from 0.25 to 5% by weight based on the weight of the aqueous dispersion.

Likewise, surfactants and wetting agents can be added to the dispersions. The wetting agents include, for example, based on perfluorinated carboxylic acids (Fluorad® FC98).

All documents referred to herein are specifically incorporated by reference in their relevant parts in entirety.

The priority document DE 198 39 454.3, filed Aug. 29, 1998, is incorporated herein by reference in its entirety.

As used herein, singular articles such as "a", "an", "the" and the like can connote the singular or plural of the object that follows.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A recording material comprising a substrate, a ceramic layer applied to the surface of the substrate and a light sensitive layer, wherein the ceramic layer comprises at least one silicate compound and aluminum oxide having aluminum with a purity of at least 99.6% by weight, the ceramic layer adheres to the substrate and the silicate compound is a sodium silicate in the form of sodium water glass, which functions as a binder, wherein the solids contents of an aqueous solution of the sodium water glass is 30% by weight and from 2 to 4 mole of $SiO_2$ are present per 1 mole of $Na_2O$ and the proportion of sodium oxide ($Na_2O$) is from 5 to 10% based on the weight of the ceramic layer.

2. A recording material as claimed in claim 1, wherein the aluminum oxide is pulverized and the particle size of the pulverized aluminum oxide is in the range from 0.20 to 3 $\mu$m, and wherein the aluminum oxide is applied together with the silicate compound and water as an aqueous dispersion to the substrate and is bound to the substrate by heating.

3. A recording material as claimed in 2, wherein the aqueous dispersion comprises from 0.25 to 5% by weight of at least one additive selected from the group consisting of silicone resin emulsions, phenylmethylpolysiloxane resin solutions, modified acrylic copolymers, xylene, propylene glycol, antifoams based on mineral oils and polysiloxanes.

4. A recording material as claimed in claim 1, wherein the aluminum oxide has aluminum with a purity of 99.6 to 99.8% by weight and the ceramic layer further comprises sodium oxide, silicon oxide, iron oxide, calcium oxide and magnesium oxide.

5. A recording material as claimed in claim 1, wherein the ceramic layer comprises aluminum oxide, at least one titanium compound and said silicate compound.

6. A recording material as claimed in claim 5, wherein the titanium compound is $TiO_2$ and is present in said ceramic layer in an amount from 10 to 90% by weight, based on the weight of the ceramic layer.

7. A recording material as claimed in claim 1, wherein the ceramic layer comprises aluminum oxide, at least one silicon compound and said silicate compound.

8. A recording material as claimed in claim 7, wherein the silicon compound is $SiO_2$, and the amount of $SiO_2$ in the silicon compound together with the $SiO_2$ from the silicate compound is from 25 to 80% by weight based on the weight of the ceramic layer, and an amount of $Na_2O$ from the silicate compound is from 5 to 10% by weight based on the weight of the ceramic layer, and the percentage of aluminum oxide makes up the balance to 100% by weight based on the weight of the ceramic layer.

9. A recording material as claimed in claim 1, wherein the molar ratio of $SiO_2$ to $Na_2O$ is from 3.0 to 3.5.

10. A recording material as claimed in claim 1, wherein the ceramic layer comprises a fluorinated hydrocarbon compound in an amount of up to 1% by weight based on the weight of the ceramic layer.

11. A recording material as claimed in claim 10, wherein the fluorinated hydrocarbon compound is polyvinylidene fluoride.

12. A recording material as claimed in claim 1, wherein the ceramic layer comprises a copolymer of vinyl chloride and vinyl isobutyl ether.

13. A recording material as claimed in claim 1, wherein the ceramic layer comprises aluminum oxide, titanium dioxide, silicon dioxide and the silicate compound.

14. A recording material as claimed in claim 13, wherein the amount of aluminum oxide is from 35 to 55% by weight, and the amount of titanium dioxide and of silicon dioxide are each from 15 to 25% by weight, and the amount of sodium oxide from the silicate compound is from 5 to 8% by weight based on the weight of the ceramic layer.

15. A recording material as claimed in claim 1, further comprising at least one cellulose compound as a stabiliser and wherein the ratio of said cellulose compound to the sodium water glass is from 1.5:1 to 4:1.

16. A recording material as claimed in claim 1, wherein the substrate is a metal or an alloy selected from the group consisting of aluminum, steel, brass and copper.

17. A recording material as claimed in claim 1, wherein the ceramic layer has a thickness of from 3.2 to 20 $\mu$m.

18. A recording material as claimed in claim 1, wherein the proportion of sodium oxide is from 7.7 to 9.5%, based on the weight of the ceramic layer.

19. A lithographic printing plate comprising a recording material as claimed in claim 1.

20. A process for producing a recording material comprising:

applying an aqueous dispersion of aluminum oxide and a silicate compound, either alone or together with titanium dioxide and/or silicon dioxide, to a substrate, and drying said substrate with said aqueous dispersion in a first drying step at a temperature of from 140° to 220° C. for from 50 to 120 seconds, wherein said silicate compound is a sodium silicate in the form of sodium water glass, which functions as a binder.

21. A process as claimed in claim 20, wherein said drying is conducted at a temperature of from 150° C. to 220° C. for from 50 to 80 seconds.

22. A process as claimed in claim 20, further comprising drying said substrate with said aqueous dispersion in a second drying step at a temperature of from 190 to 280° C.

23. A process according to claim 20, wherein the applying of the aqueous dispersion is conducted using a pad, a roller or a doctor blade.

* * * * *